United States Patent [19]

Ito

[11] Patent Number: 4,462,214

[45] Date of Patent: Jul. 31, 1984

[54] CRYOSTAT

[75] Inventor: Daisuke Ito, Yokohama, Japan

[73] Assignee: Tokyo Shibaura Denki Kabushiki Kaisha, Kawasaki, Japan

[21] Appl. No.: 379,090

[22] Filed: May 17, 1982

[30] Foreign Application Priority Data

May 20, 1981 [JP] Japan ..... 56-74845

[51] Int. Cl.[3] ..... F17C 1/00

[52] U.S. Cl. ..... 62/45; 62/514 R; 206/524.3; 220/457; 220/461

[58] Field of Search ..... 62/514 R, 45; 206/524.2, 524.3, 524.9; 220/457, 460, 461

[56] References Cited

U.S. PATENT DOCUMENTS 3,216,559 11/1965 Forbes et al. ..... 206/524.3

3,606,958 9/1971 Coffman ..... 220/453

OTHER PUBLICATIONS

7th Symposium on Engineering Problems of Fusion Research, vol. II, "ANL Experimental Program for Pulsed Superconducting Coils", by S. T. Wang et al., 1977, pp. 1322–1325.

Proc. of International Symposium on Superconductive Energy Storage, "Argonne National Laboratory Superconducting Pulsed Coil Program", by S. T. Wang et al., 1979.

*Primary Examiner*—Ronald C. Capossela

*Attorney, Agent, or Firm*—Oblon, Fisher, Spivak, McClelland & Maier

[57] ABSTRACT

A cryostat comprises an inner tank to be contacted with a cryogenic fluid and an outer tank surrounding the inner tank. The inner tank is formed of fiber-glass reinforced vinyl polyester resin.

6 Claims, 2 Drawing Figures

CRYOSTAT

BACKGROUND OF THE INVENTION

I. Field of the Invention

The present invention relates to a cryostat and, more particularly, to a cryostat formed of a fiber-glass reinforced plastic.

II. Description of the Prior Art

A cryostat is used when cryogenic fluid, e.g., liquid helium used for cooling a superconducting device, liquid nitrogen, liquid oxygen, or liquefied natural gas used for the other utilities, is stored and transported. The cryostat should be formed of a material which can endure the temperature (4.2° K for the liquid helium) of such a cryogenic fluid.

Metallic materials and organic materials generally tend to increase their tensile strength in the vinicity of the cryogenic temperature. At the same time, however, they are brittle and their elongation is reduced. Since general organic materials in particular has heat transfer coefficients ten to hundred times lower than those of metallic material, they have relatively low heat losses due to heat conduction. They are accordingly considered to be adequate for storing cryogenic fluid. However, the material should be considerably thicker than the metal so as to provide a structure having a predeterminded tensile strength.

The conventional cryostats have been composed of metallic materials, e.g., stainless steel, at the cost of heat loss characteristic of the metallic materials. When a cryogenic device e.g., a superconducting pulse magnet (used for a troidal coil for a nuclear fusion reactor) producing change with time of a magnetic field is operated in a metallic cryostat, an eddy current will flow due to its electromagnetic induction in the metallic cryostat, and cryogenic fluid, e.g., liquid helium contained in the cryostat, is disadvantageously evaporated due to the Joule's heat of the eddy current. This is the result of the electric conductivity of the metal.

SUMMARY OF THE INVENTION

Accordingly, it is an object of the present invention to provide a cryostat which has excellent thermal and electrical insulations.

It is another object of the present invention to provide a cryostat having a light weight and excellent strength characteristic.

It is still another object of the present invention to provide a cryostat adapted for a large size.

In order to achieve the above and other objects, a cryostat comprising an inner tank in direct contact with a cryogenic fluid and an outer tank surrounding the inner tank is provided according to the present invention. The inner tank is formed of fiber-glass reinforced vinyl polyester resin. The outer tank is formed preferably of similar fiber-glass reinforced vinyl polyester resin.

The cryostat according to the present invention does not crack even if it stores the cryogenic fluid over a relatively long period of time. Its heat insulation property is also satisfactory. Because the cryostat of the invention is made of material having excellent electrical insulation, the problem of evaporating cryogenic fluid due to Joule's heat as observed in the cryostat made of metallic material does not occur.

DETAILED DESCRIPTION OF THE PREFERRED EMBODIMENT

The present invention will now be described in more detail with reference to the accompanying drawings.

Figure 1:
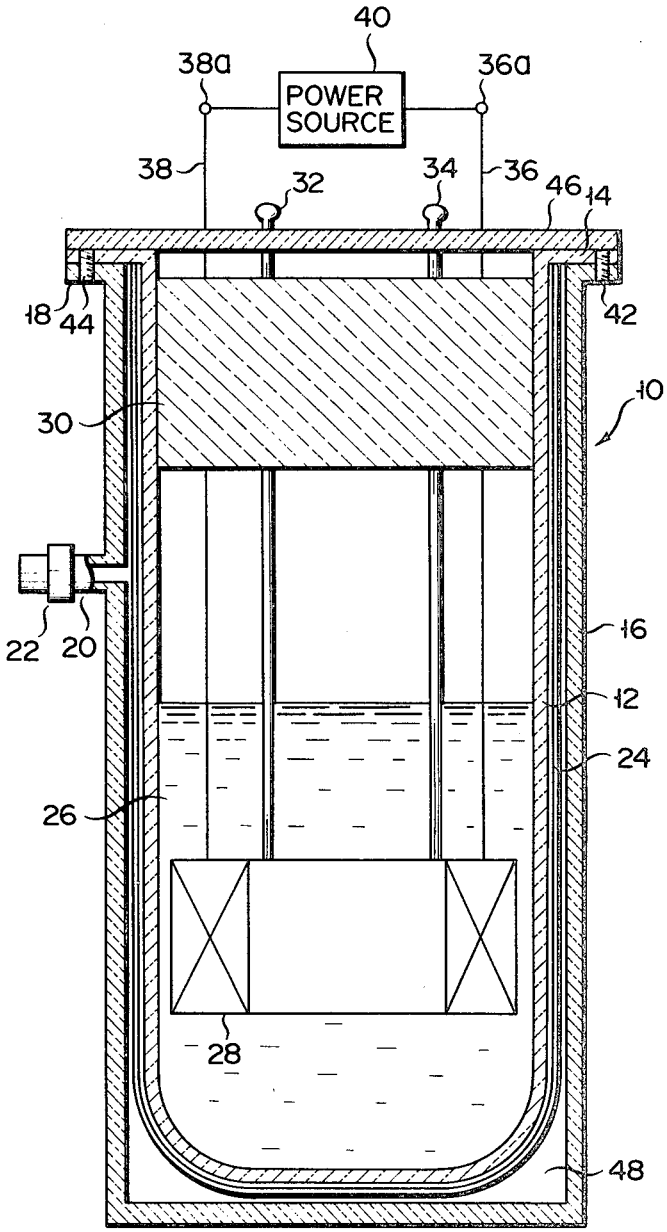
FIG. 1 is a schematic sectional view of the cryostat according to one preferred embodiment of the present invention.

A cryostat 10 shown in FIG. 1 comprises an inner tank 12 and an outer tank 16 which surrounds the inner tank 12. The inner tank 12 is formed of fiber-glass reinforced vinyl polyester resin. The vinyl polyester resin differs from so-called "unsaturated polyester resin", but has vinyl ester groups at both terminal ends. It does not, however, have an unsaturated bond in a main chain. The preferable vinyl polyester is represented by the following formula:

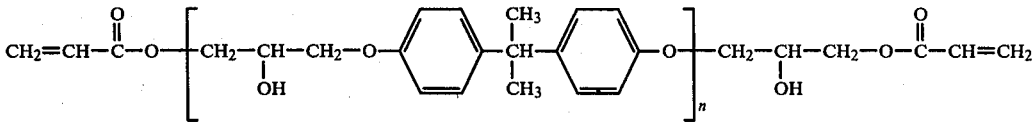

where n is 1 to 4. This polyester is available commercially under, for example, the trade name "Ripoxy R802" from Showa High Polymer Co., Ltd. of Japan.

In order to produce the inner tank 12 with the vinyl polyester resin, a method well known in the art can be used. Most preferably, the inner tank 12 is formed integrally without joints by using a hand lay-up process. The hand lay-up process is, as is well known, a process for superposing glass fiber mats, cloths, roving cloths or the like adhered with the resin in multiple layers by laminating with a brush or roller. For example, four layers of cloth impregnated with the resin and four layers of roving cloth impregnated with the resin are alternately laminated between two surface mats also impregnated with the resin, thereby obtaining a ten-layer inner tank which is 12 mm thick. Or, the inner tank 12 may be formed integrally without joints by combining the hand lay-up process and the filament winding process. For example, if the inner tank 12 has a semispherical bottom and a cylindrical body as shown in FIG. 1, the bottom may be formed by the hand lay-up process, while the body may be formed by the filament winding process. Thereafter, the bottom and the body are formed by laminating the glass cloth or mat impregnated with the polyester resin alternately at the end. The filament winding process involves, as is well known, winding the glass fiber adhered with the resin on a mandrel.

The vinyl polymer is hardened or cured by mixing a small amount (e.g., 1% 2%) of hardener, e.g., methyl ethyl ketone peroxide in advance in the resin.

The glass content of the fiber-glass reinforced vinyl polyester forming the inner tank 12 is normally 30% to 50% by weight and preferably 45% to 50% by weight.

The outer tank 16 is formed of the same fiber-glass reinforced vinyl polyester resin as the inner tank 12. The outer tank 16 has an exhaust tube 20 on which a vacuum-sealing valve 22 is mounted.

The inner and outer tanks 12 and 16 are securely fixed at the flanges 14 and 18 with bolts 42 and 44.

A superinsulation 24 is wound around the outer surface of the inner tank 12. The superinsulation 24 may comprise a plurality of, for example, 100 polyester thin sheets having aluminum thin films vapor-deposited on their both surfaces. The superinsulation can prevent heat from entering from the exterior of the inner tank 12.

The open end of the cryostat 10 is closed with a cover 46 similarly formed of the fiber-glass reinforced vinyl polyester resin.

Cryogenic fluid 26, e.g., liquid helium, is contained in the inner tank 12 of the cryostat 10, and cryogenic device 28, e.g., a superconducting pulse magnet, is immersed in the fluid 26. A heat insulator 30 made of, for example, hard polyurethane, is installed at the upper of the liquid surface of the fluid 26 for preventing the thermal invasion from the open end side. The cryogenic device 28 is suspended via suspension members 32, 34 passing through the cover 46 and the heat insulator 30. A pair of leads 36, 38 extend from the cryogenic device 28 to the outside of the cryostat 10, and are connected at their terminals 36*a* and 38*a* to a power source 40. Electric currents of, for example, 2,000 A (which corresponds to heat invasion amount of 2 W) are flowed from the power source 40 through the leads 36 and 38 respectively to the cryogenic device 28. After the space between the inner tank 12 and the outer tank 15 is evacuated from the exhaust tube 20 by a vacuum pump (not shown), the valve 22 is then closed. Thus, a vacuum heat insulating layer 48 is formed.

When a thermal cycle is applied to the cryostat thus constructed, no crack occurs. The degree of vacuum of the vacuum heat insulating layer is very high in the state that the vacuum-sealing vale is sealed when the liquid helium is contained in the inner tank. The heat invasion amount is very small since the tank is mainly formed of organic material. Inasmuch as an eddy current will not flow due to the electromagnetic induction in the cryostat formed of fiber-glass reinforced vinyl polyester resin, the quantity of evaporated liquid helium is very small as compared with the cryostat made of metallic material, e.g., stainless steel.

EXAMPLE

An inner tank having a height of 1,600 mm and an inner diameter of 620 mm was produced by alternately laminating each of the four glass clothes and each of the four roving clothes impregnated with Ripoxy R802 between two glass surface mats impregnated with Ripoxy R802. The glass content of the inner tank was 50% by weight. The inner tank was subjected to a thermal cycle of from liquid nitrogen temperature to room temperature or vice versa five times by charging and discharging liquid nitrogen. No crack was formed.

A tank was produced in the same manner as above except that an ordinary unsaturated polyester resin was used instead of Ripoxy R802. The same thermal tests were conducted. This time, cracks were formed.

100 sheets of polyester films deposited with aluminum on both surfaces were wound around the outer surface of the inner tank produced according to the present invention. A cryostat was produced by combining the outer tank similarly produced with the inner tank. When liquid nitrigen was filled in the cryostat, the degree of vacuum of the space between the inner tank and the outer tank decreased to less than $6\times10_{-7}$ Torr.

Figure 2:
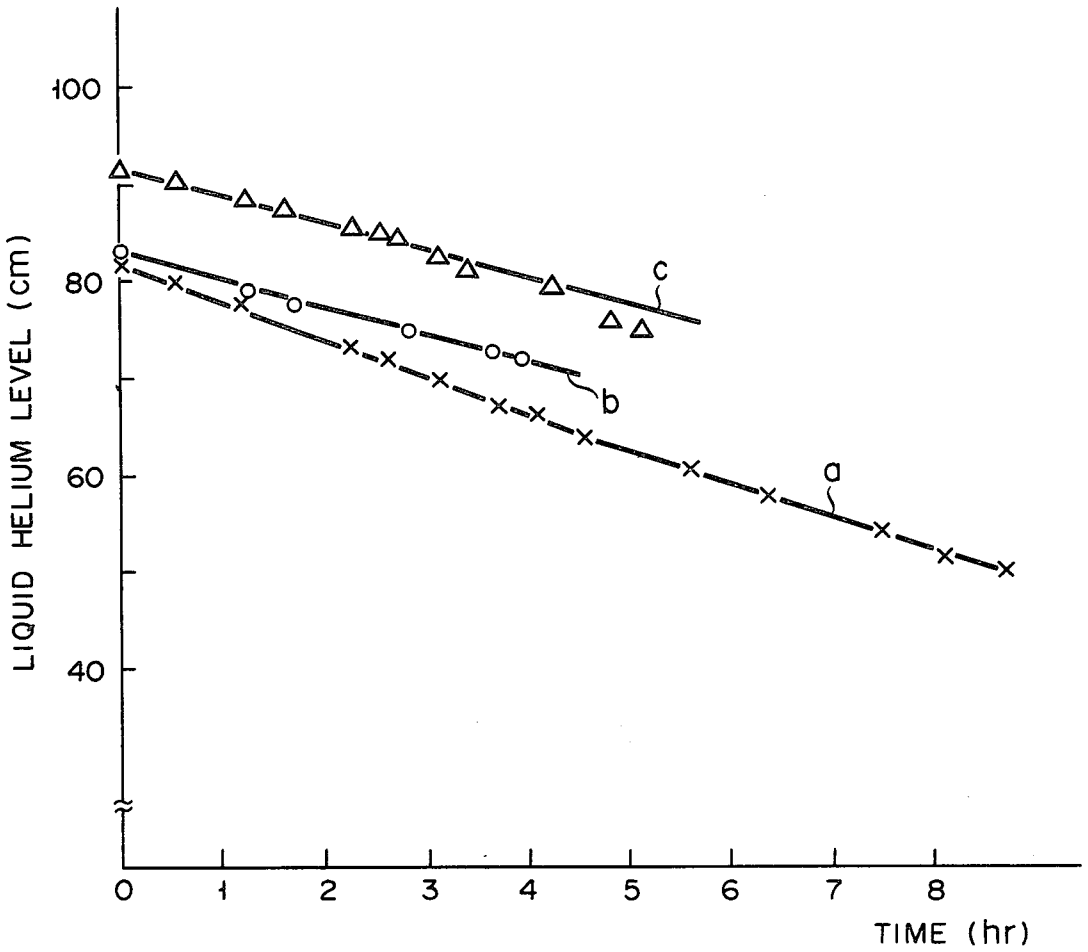
FIG. 2 is a graph showing the performance of the cryostat of the present invention.

When the liquid nitrogen was exhausted, a pulse magnet was installed in the inner tank, into which liquid helium was then filled. The change with time of the surface level of the liquid helium was examined. The results are shown in FIG. 2. A curve a represents the result of the first operation, a curve b represents the result of the second operation, and a curve c represents the result of the third operation. The total heat invasion amount was calculated to be 5.4 W from the change of the surface level. Because 2 W of heat was invaded from each lead, the heat invasion amount other than that from the leads can be calculated to be only 1.4 W (5.4 W−4 W). There was little variation in the degree of vacuum in the space between the inner tank and the outer tank.

The present invention has been described with reference to the embodiments, but it should not be limited thereto. Various changes and modifications may be made within the spirit and scope of the present invention. For example, the outer tank 16 may be formed of the material other than the fiber-glass reinforced vinyl polyester, e.g., metallic material (stainless steel, etc.) or other fiber-glass reinforced plastic.

What is claimed is:

1. A cryostat for storing cryogenic fluid, comprising:

an inner tank to be in contact with a crogenic fluid and formed of fiber-glass reinforced vinyl polyester resin, wherein said vinyl polyester resin is formed from monomers represented by the formula:

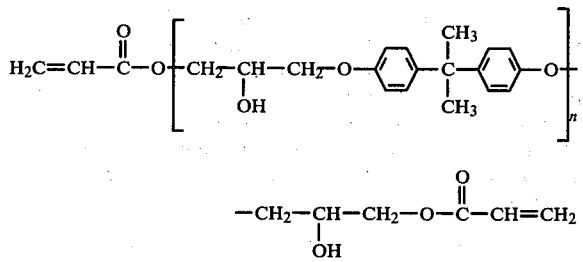

wherein n is 1 to 4; and an outer tank surrounding said inner tank.

2. The cryostat according to claim 1, wherein said fiber-glass reinforced resin contains 30% to 50% by weight of glass.

3. The cryostat according to any of claims 1 or 2, wherein said outer tank is formed of fiber-glass reinforced vinyl polyester resin.

4. The cryostat according to claim 1, wherein said vinyl polyester resin forming said outer tank is represented by the formula:

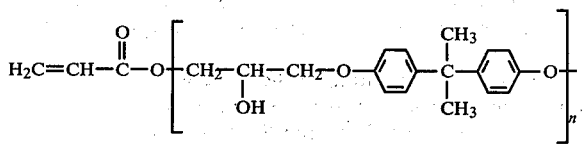

-continued

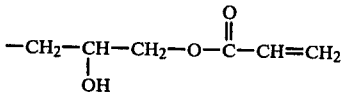

where n is 1 to 4.

5. A cryogenic apparatus, comprising:

a cryostat composed of an inner tank formed of fiber-glass reinforced vinyl polyester resin, wherein said vinyl polyester resin is formed from monomers represented by the formula:

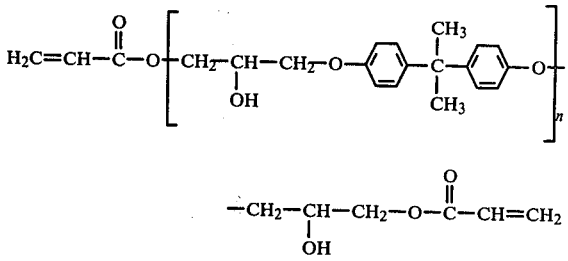

wherein n is 1 to 4, and an outer tank surround said inner tank;

a cryogenic fluid contained in the inner tank of said cryostat;

a cryogenic device immersed in said cryogenic fluid; and means for operating said cryogenic device.

6. The apparatus according to claim 5, wherein said fiber-glass reinforced resin contains 30% to 50% by weight of glass content.

* * * * *